United States Patent [19]

Pignan et al.

[11] 4,263,117

[45] Apr. 21, 1981

[54] DEVICE FOR THE RECOVERY OF GASES FORMED DURING THE ELECTROLYSIS OF ALKALI METAL CHLORIDES

[75] Inventors: Jean-Louis Pignan, Grenoble; Georges Cusset, Francheville, both of France

[73] Assignee: Produits Chimiques Ugine Kuhlmann, Courbevoie, France

[21] Appl. No.: 92,337

[22] Filed: Nov. 8, 1979

[30] Foreign Application Priority Data

Nov. 14, 1978 [FR] France ..... 78 32090

[51] Int. Cl.[3] ..... C25B 15/02; C25B 1/24; C25B 9/00; C25B 1/02

[52] U.S. Cl. ..... 204/230; 204/95; 204/270; 204/128; 204/129

[58] Field of Search ..... 204/95, 128, 129, 230, 204/256, 258, 270

[56] References Cited

U.S. PATENT DOCUMENTS

| | | | |
|---|---|---|---|
| 2,578,027 | 12/1951 | Tichenor | 204/230 X |
| 2,701,790 | 2/1955 | Goument | 204/230 |
| 3,180,811 | 4/1965 | Schwanbon et al. | 204/95 |
| 3,336,215 | 8/1967 | Hagen | 204/230 |
| 4,113,601 | 9/1978 | Spirig | 204/230 |

FOREIGN PATENT DOCUMENTS

| | | | |
|---|---|---|---|
| 51-99679 | 9/1976 | Japan | 204/230 |

*Primary Examiner*—Howard S. Williams
*Assistant Examiner*—D. R. Valentine
*Attorney, Agent, or Firm*—Pennie & Edmonds

[57] ABSTRACT

Device for the recovery of gases formed during the electrolytic preparation of alkali metal chlorides, characterized by scrubbing columns having a hydraulic guard, and by automatic distribution systems for inert gas and for air, said distribution systems being controlled by the operation of the current generator and by the operating amperage of the cells, respectively.

This device permits the recovery, under satisfactory safety conditions, of the hydrogen present during the electrolysis of alkali metal chlorides for the production of alkali metal chlorates.

3 Claims, 1 Drawing Figure

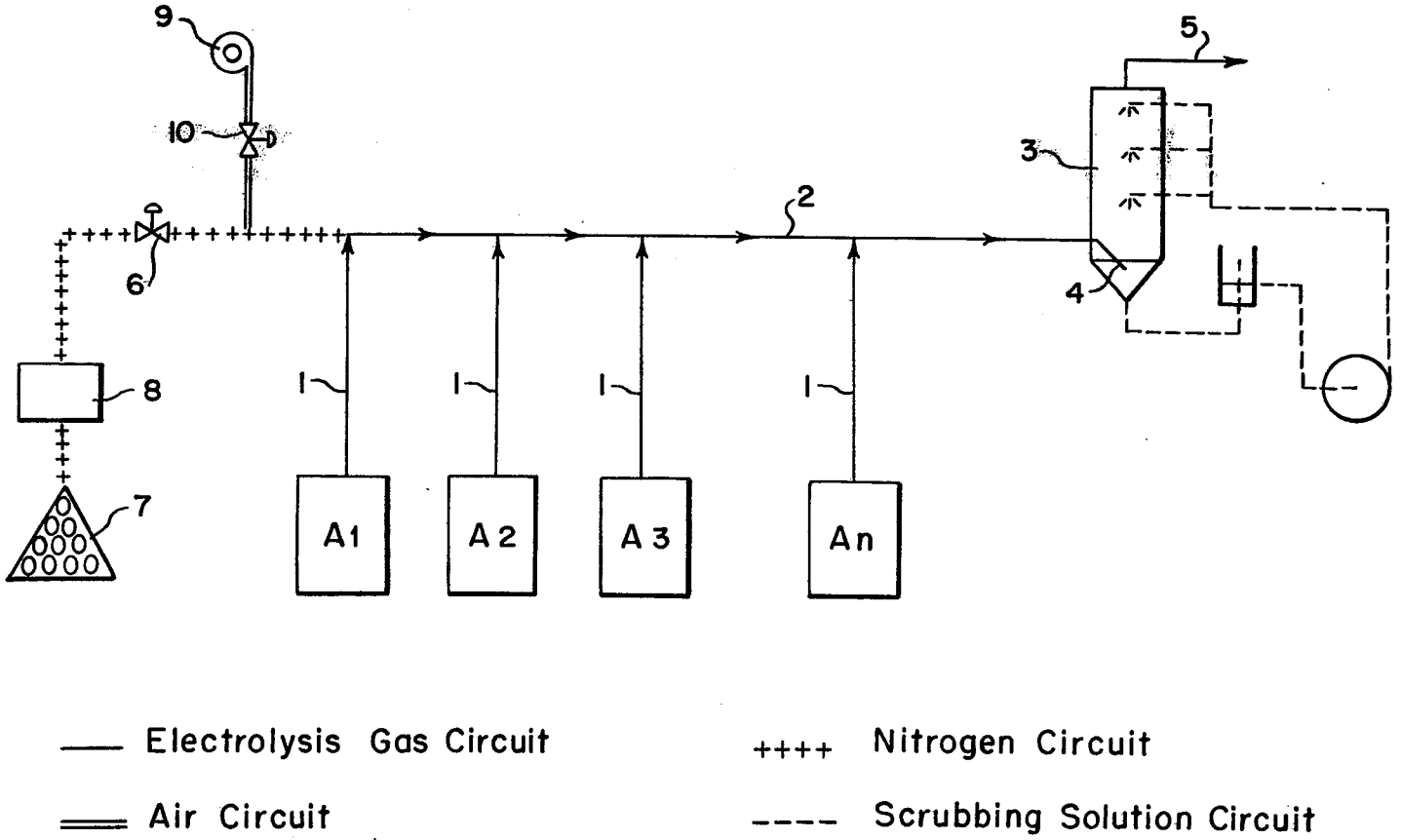
5
3
4
2
An
A3
A2
A1
9
10
6
8
7
++++ Nitrogen Circuit
---- Scrubbing Solution Circuit
— Electrolysis Gas Circuit
= Air Circuit

DEVICE FOR THE RECOVERY OF GASES FORMED DURING THE ELECTROLYSIS OF ALKALI METAL CHLORIDES

TECHNICAL FIELD

The present invention relates to a device for the recovery of gases formed during the electrolysis of alkali metal chloride solutions for the preparation of alkali metal chlorates.

BACKGROUND ART

The electrolysis of an alkaline brine, carried out with a view of obtaining alkali metal chlorates, leads to the formation of a gaseous mixture containing:

(a) hydrogen formed at the cathodes of the electrolytic cells; and (b) oxygen, chlorine and possibly carbon dioxide, formed during parasitic reactions which cause a decrease in the Faraday yield.

The composition of this gaseous mixture depends on the type of cells used, on the nature of the electrodes used, and on the operating conditions of the electrolysis.

In cells with graphite anodes which have generally been used until the last few years, the composition of the mixture was as follows:

$H_2$: 91 to 95%

$O_2$: 4 to 7%

$Cl_2$: 0.4 to 0.8%

$CO_2$: 0.4 to 1% and the recovery and treatment of this gaseous effluent posed safety problems because of its flammable and explosive nature due to the relatively high oxygen content.

The solution of this problem generally adopted for transporting and treating this mixture in the required safe manner consisted in diluting the mixture in the cells or at the exit from said cells with an amount of air calculated so as to ensure that the hydrogen content of the mixture of electrolysis gas is less than 4%, which corresponds to at least 25-fold dilution of the electrolysis gas.

Since the 1970's a new cell technology has been developed using titanium anodes coated with an electroactive layer, making it possible, with the aid of new operating conditions, to achieve a yield exceeding that of cells using graphite anodes, and to obtain a gaseous mixture having the following composition:

$H_2 > 96\%$ $O_2 < 3.5\%$ $Cl_2$: 0.2 to 0.5% which is outside the explosive range.

While it is possible to resort to the previous solution, it leads to excessively high dilutions which require the use of high-powered fans and involves a non-negligible energy consumption. Another major drawback of dilution is the fact that the recovery of the hydrogen, with a view to its subsequent utilization as a fuel or raw material, is virtually impossible.

DISCLOSURE OF THE INVENTION

The present invention relates to a device which solves the safety problems associated with the recovery of the electrolysis gas, while at the same time permitting the utilization of the hydrogen produced during the electrolysis.

The device is characterized by scrubbing columns provided with a hydraulic guard, and by automatic distribution systems for inert gas and for air, said systems being controlled by the operation of the current generator and by the operating intensity or current amplitude of the cells, respectively.

BRIEF DESCRIPTION OF THE DRAWING

The proposed device is illustrated by the drawing attached hereto.

DETAILED DESCRIPTION OF THE INVENTION

The electrolysis gases leave cells $A_1$ to $A_n$ through pipes 1 situated at the upper part of the cells, and are collected in one or more main pipes 2 through which they are conveyed to one or more scrubbing columns 3 for the removal of chlorine in a conventional and known manner.

The assembly of cells is kept under pressure by means of a hydraulic guard 4 arranged at the bottom of the gas scrubbing columns. The pressure of this guard, which may range from 10 mm to 200 mm of water, depending on the installation and the operating conditions, is adjusted so that the cells are kept under pressure to prevent any accidental entry of air which could make the gaseous mixture explosive, and to ensure that the upward force of the hydrogen produced is sufficient to overcome the pressure drops in the circuit, so that no fan is required for the recovery of the gases. Thus, when the electrolytic installation is in normal operation, a natural liberation of electrolysis gas takes place; the gas is then conveyed to the scrubbing columns and washed free of chlorine, whereupon at the outlet of the scrubbing section 5 a hydrogen gas containing less than 3.5% oxygen is obtained which may be used as such or purified for possible future use.

In addition, the device comprises safety means which makes it possible to maintain the safety of the installation under transitory conditions such as current tripping or stoppage or operations at a reduced current strength.

Indeed in these cases, as the oxygen content increases, the composition of the gaseous mixture changes until it can become explosive.

In the event of an interruption of the electrical circuit, such as by current tripping, an automatic valve 6 controlled by the operation of the current generator is opened, permitting the entry into the gas collector or collectors of the cells, 2, and into the cells $A_1$ to $A_n$, of nitrogen or another inert gas from a reservoir 7 and an expansion means 8 which permits regulation of the flow of inert gas. The cells and gas pipes are thus swept by the inert gas which takes the place of the electrolysis gas while maintaining the installation under pressure. One variant of this system consists in carrying out a sweeping operation over a given period and then automatically stopping it at the end of this period.

In case of operating at a reduced intensity, e.g., at 1/10 of normal current, a fan 9 draws air and forces it into the cells and gas collectors through the intermediary of an automatic valve 10 controlled by the intensity of operation of the cells or the current amplitude. The flow rate of air is fixed by the characteristics of the fan or fans, said characteristics themselves being fixed by the dilution required to obtain a non-explosive gaseous mixture. The power required by the fan is limited, because this device is required to operate only during low operating intensities, (amperage), during which the rate of flow of gas formed remains quite low.

Mechanisms for automatically actuating valve 6 as a result of an interruption of the electrical circuit, such as power failure or actuating valve 10 and fan 9 as a result of reduced current strength or current density, are well known and thus not illustrated in the drawing. Electronic relays or solenoids, for example, can be used to actuate the valves 6 or 10, alone or through an auxiliary power source, or a full electronic system involving the use of silicon rectifiers could also be used. These mechanisms can be adjusted to actuating these valves upon complete power failure or reduced current strength, and can also be regulated to automatically stop the inert gas or air flow at the end of a given period.

BEST MODE FOR CARRYING OUT THE INVENTION

The following example illustrates, in a non-limitative manner, the device according to the invention designed for the recovery of gases formed during the electrolysis of alkali metal chlorates.

EXAMPLE

In a plant for the electrolysis of sodium chloride, for producing sodium chlorate, producing 1 ton of sodium chlorate per hour, the cells release 665 $m^3$ of hydrogen per hour 13.5 $m^3$ of oxygen per hour 1.4 $m^3$ of chlorine per hour measured under standard conditions of temperature and pressure (0° C.—1 bar).

The plant comprises 50 electrolyzers A operating at 32,000 amperes and divided into 2 production lines of 25 cells each. Arranged above each line is a gas collector 2 having a diameter of 150 mm, which recovers the gases of each cell of the corresponding line and which terminates at a scrubbing column 3. The hydraulic guard 4 of the scrubbing means is adjusted to a height of 50 mm of water, and the gases then escape freely from the cells, circulate in the collectors and pass through the scrubbing columns without the intervention of any driving force. The pressure created in the installation prevents any accidental entry of air, and the conveyed gaseous mixture thus remains within the required safety range.

In the event of tripping or current failure, the valve 6 is opened by means of an appropriate switch which is activated by current failure and nitrogen is conveyed to the gas collecting system at a rate of flow, regulated by the expansion means 8, of 20 $m^3$/hour into each gas collector, with the cells always kept under pressure through the hydraulic guard.

If the installation is required to operate at a reduced amperage, e.g., at 1000 amperes, an appropriate switch is activated, by sensing the reduced current, which activates the valve 10 and the fan 9. The fan 9 sends air into each collector at a rate of 350 $m^3$/h set by the valve 10, at a pressure that is slightly above that of the hydraulic guard.

We claim:

1. A device for the recovery of potentially explosive gases formed in the electrolytic cells during the electrolysis of alkali metal chlorides to form alkali metal chlorates, said gases comprising hydrogen, oxygen and chlorine, which comprises a current generator for supplying current to the cells, means for providing pressure in the cells, means for removing the gases formed during electrolysis to chlorine scrubbing columns to remove the chlorine gas, means for recovering the hydrogen gas, means comprising a hydraulic pressure guard in said scrubber columns to maintain the pressure in the cells during transfer of the gases to the scrubber, means automatically operated by the current generator to automatically purge the cells with an inert gas upon interruption of the current, and means automatically operated by sensing the amperage of the cells for forcing air into the cells in a sufficient amount to maintain the gases contained in the cells in a non-explosive mixture with air upon reduction of the operating amperage of the cells during which the rate of gas flow remains low.

2. A device according to claim 1, in which the pressure of the hydraulic guard is between about 10 mm and 200 mm of water.

3. A device according to claim 1 or 2 which includes means for automatically cutting off the flow of inert gas after a given length of time.

* * * * *